US005924786A

United States Patent [19]

Lin

[11] Patent Number: 5,924,786

[45] Date of Patent: Jul. 20, 1999

[54] SERIAL LAMP ASSEMBLY

[76] Inventor: Mei-Lu Lin, 56, Min Sheng Street, Fengyuan, Taichung Shien, Taiwan, 420

[21] Appl. No.: 08/912,461

[22] Filed: Aug. 18, 1997

[51] Int. Cl.[6] ..... F21V 21/00

[52] U.S. Cl. ..... 362/249; 362/252; 362/250

[58] Field of Search ..... 362/252, 250, 362/391, 396, 239, 249, 238, 806

[56] References Cited

U.S. PATENT DOCUMENTS 5,672,000 9/1997 Lin ..... 362/806
5,779,352 7/1998 Lin ..... 362/252
5,791,765 8/1998 Lin ..... 362/252
5,800,046 9/1998 Lin ..... 362/252

*Primary Examiner*—Sandra O'Shea
*Assistant Examiner*—Todd Reed Hopper

[57] ABSTRACT

A serial lamp assembly has a net device, and a plurality of lamps disposed on the net device. Each lamp has a bulb, a lamp holder receiving the bulb, a socket receiving the lamp holder, a plurality of round posts disposed on the socket, a first wire extended from the socket, and a second wire extended from the socket. A first plate has a plurality of round holes. A second plate has a plurality of circular holes. A U-shaped rod passes through the net device and is inserted in the circular holes. The round posts pass through the net device and are inserted in the round holes.

6 Claims, 8 Drawing Sheets

SERIAL LAMP ASSEMBLY

BACKGROUND OF THE INVENTION

This invention relates to a serial lamp assembly, and more particularly to a serial lamp assembly which contains a plurality of decoration lamps.

A conventional serial lamp assembly is disposed on a fabric. However, the fabric should perforate a plurality of holes to receive the respective clamps. Furthermore, the fabric may fall down under a strong wind while the fabric is placed outdoors. In addition, the serial decoration lamp assembly may fall off from the fabric.

SUMMARY OF THE INVENTION

An object of this invention is to provide a serial lamp assembly which can be positioned on a net easily and stably.

DETAILED DESCRIPTION OF THE INVENTION

Figure 1:
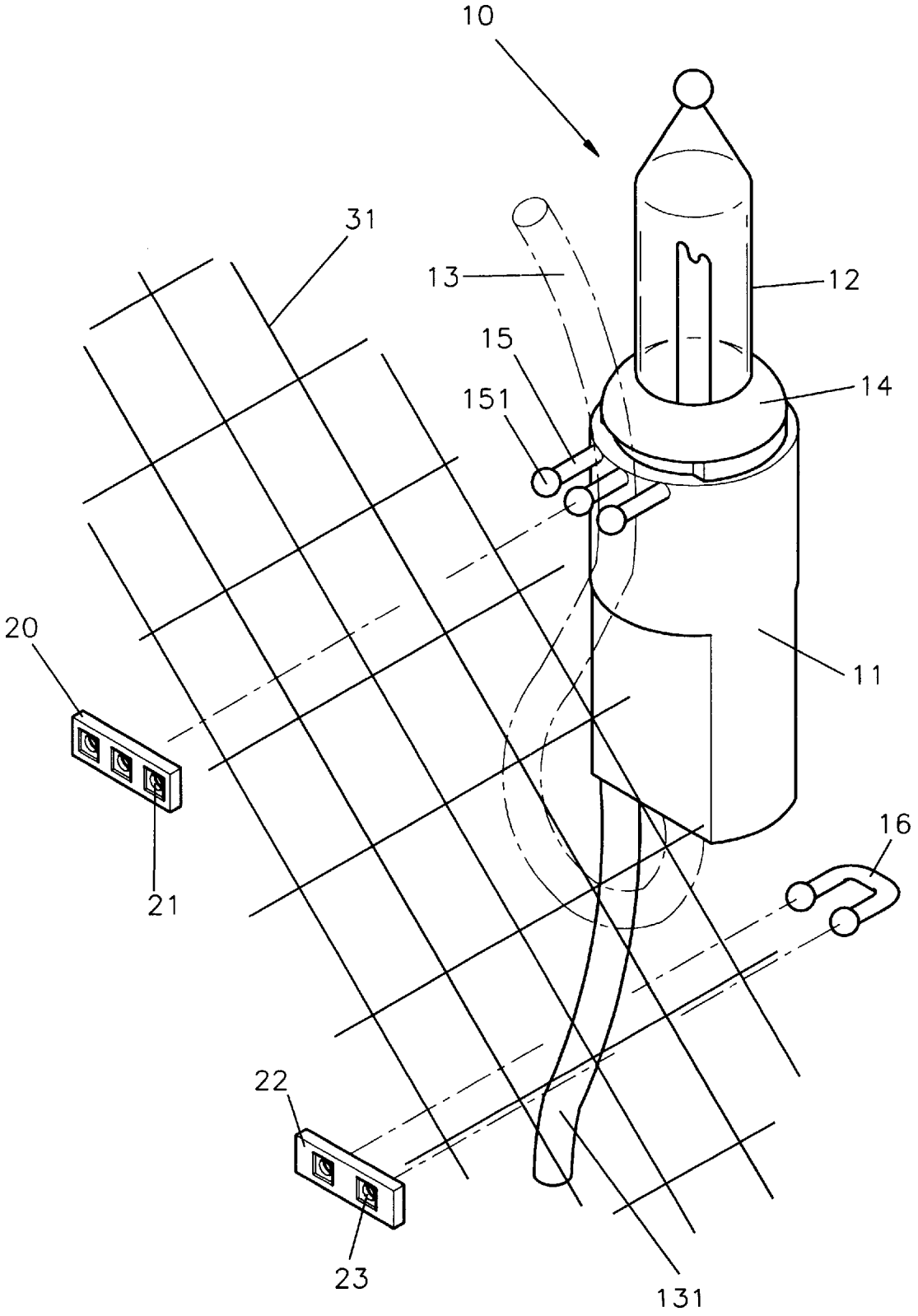
FIG. 1 is a perspective view of a first lamp and a portion of a net device.
Figure 2:
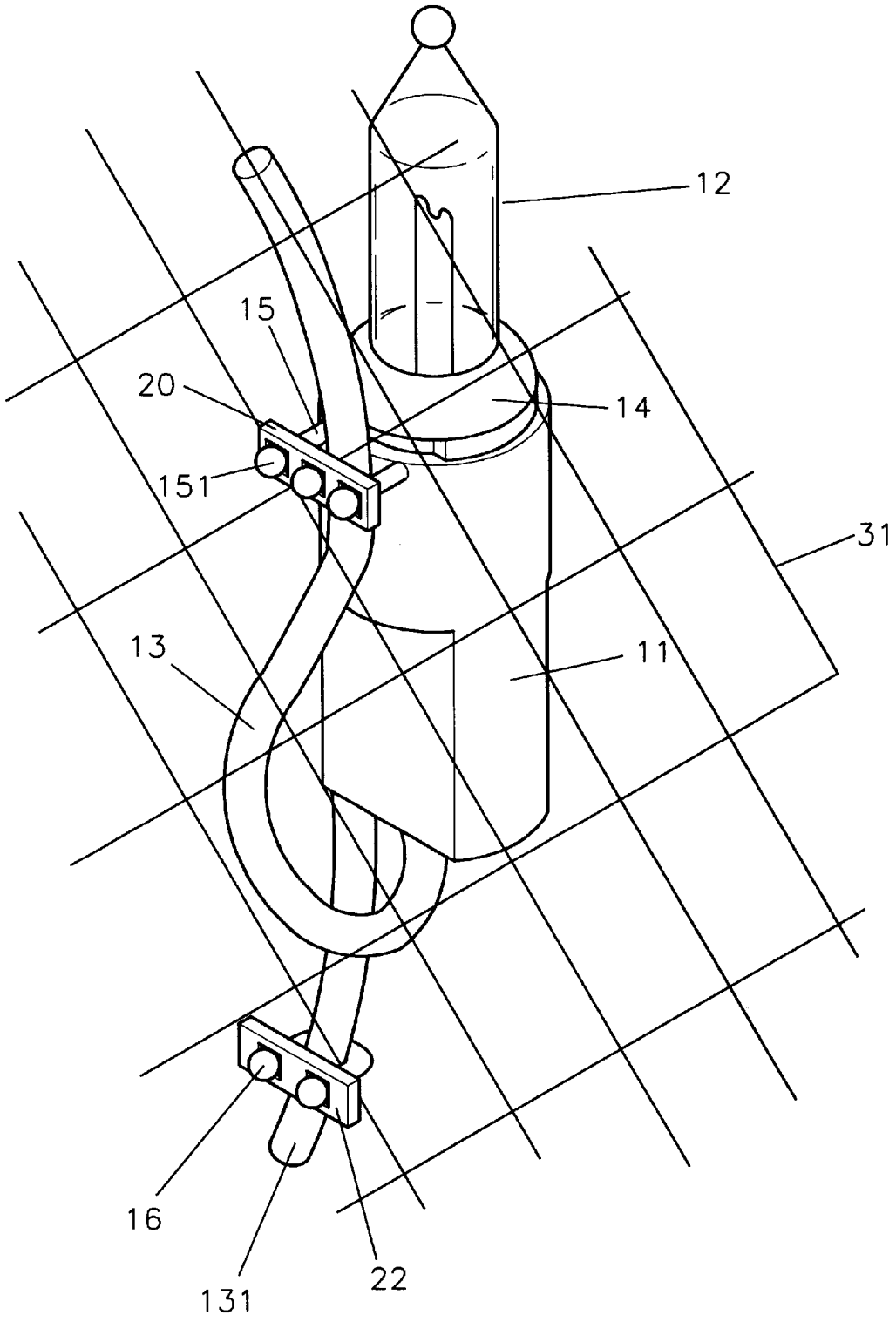
FIG. 2 is a schematic view illustrating a lamp fastened on a net device.
Figure 3:
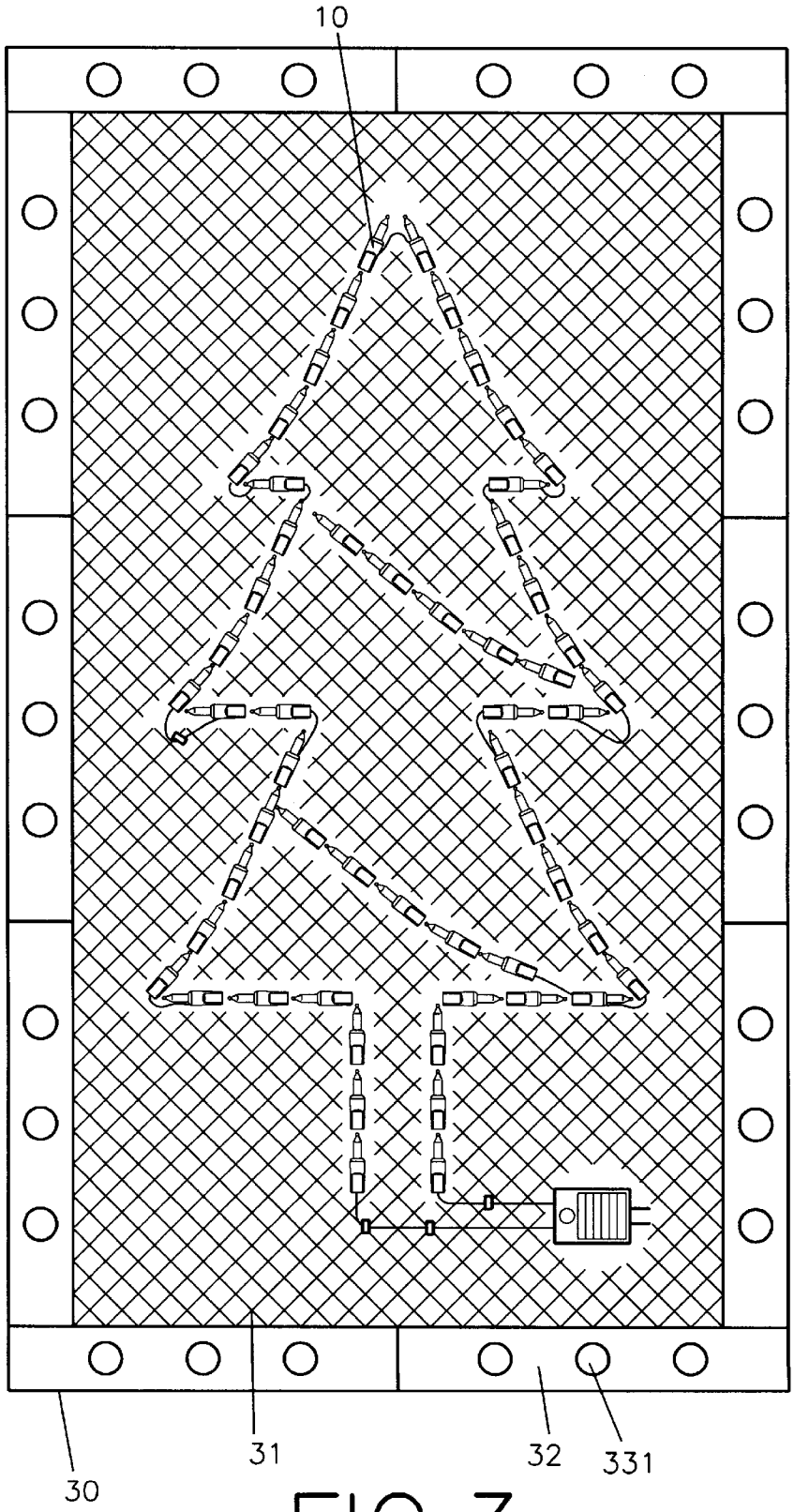
FIG. 3 is an elevational view of a serial lamp assembly.

Referring to FIGS. 1, 2, 3, and 7, a serial lamp assembly comprises a net device 30, and a plurality of lamps 10 disposed on the net device 30. Each lamp 10 has a bulb 12, a lamp holder 14 receiving the bulb 12, a socket 11 receiving the lamp holder 14, a plurality of round posts 15 disposed on the socket 11, a first wire 13 extended from the socket 11, and a second wire 131 extended from the socket 11. A first plate 20 has a plurality of round holes 21. A second plate 22 has a plurality of circular holes 23. A U-shaped rod 16 passes through the net device 30 and is inserted in the circular holes 23. The round posts 15 pass through the net device 30 and are inserted in the round holes 21. Each round post 15 has a ball end 151.

The net device 30 has a plurality of net strings 31, a plurality of first panels 32, and a plurality of second panels 33 coupled with the first panels 32. Each first panel 32 has a plurality of through holes 321. Each second panels 33 has a plurality of pillars 331 passing through the net strings 31 and inserted in the through holes 321.

Figure 4:
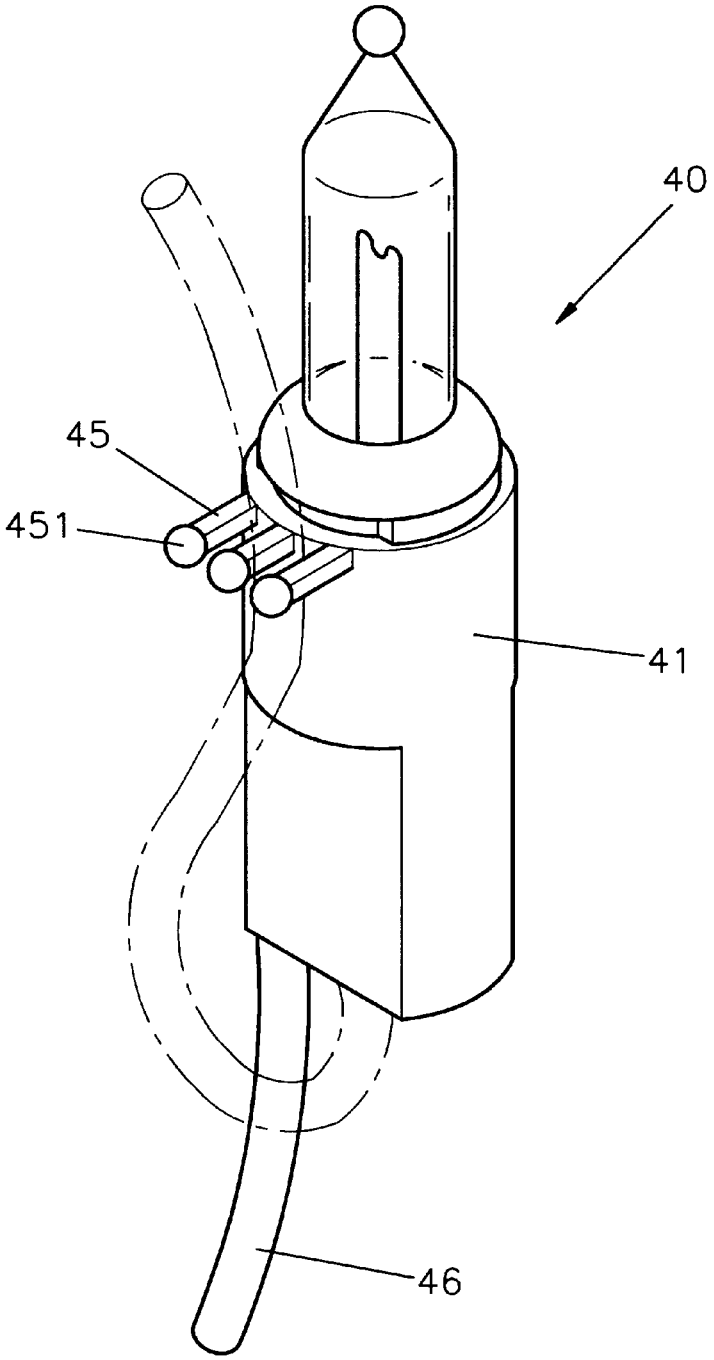
FIG. 4 is a perspective view of a second lamp.

Referring to FIG. 4, a second lamp 40 comprises a socket 41, a plurality of rectangular posts 45 disposed on the socket 41, and two wires 46 extended from the socket 41. Each rectangular post 45 has a ball end 451.

Figure 5:
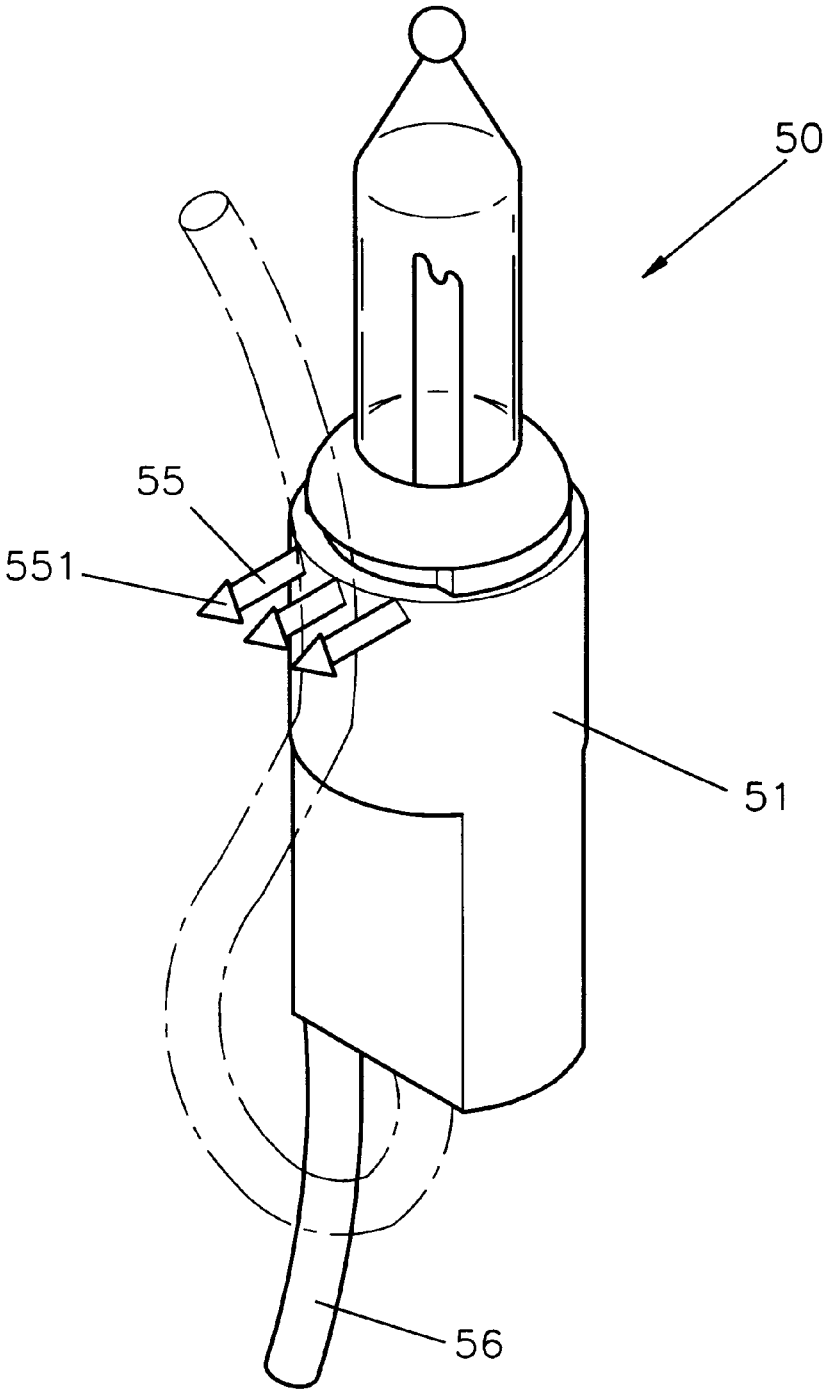
FIG. 5 is a perspective view of a third lamp.

Referring to FIG. 5, a third lamp 50 comprises a socket 51, a plurality of triangular posts 55 disposed on the socket 51, and two wires 56 extended from the socket 51. Each triangular post 55 has an arrowheaded end 551.

Figure 6:
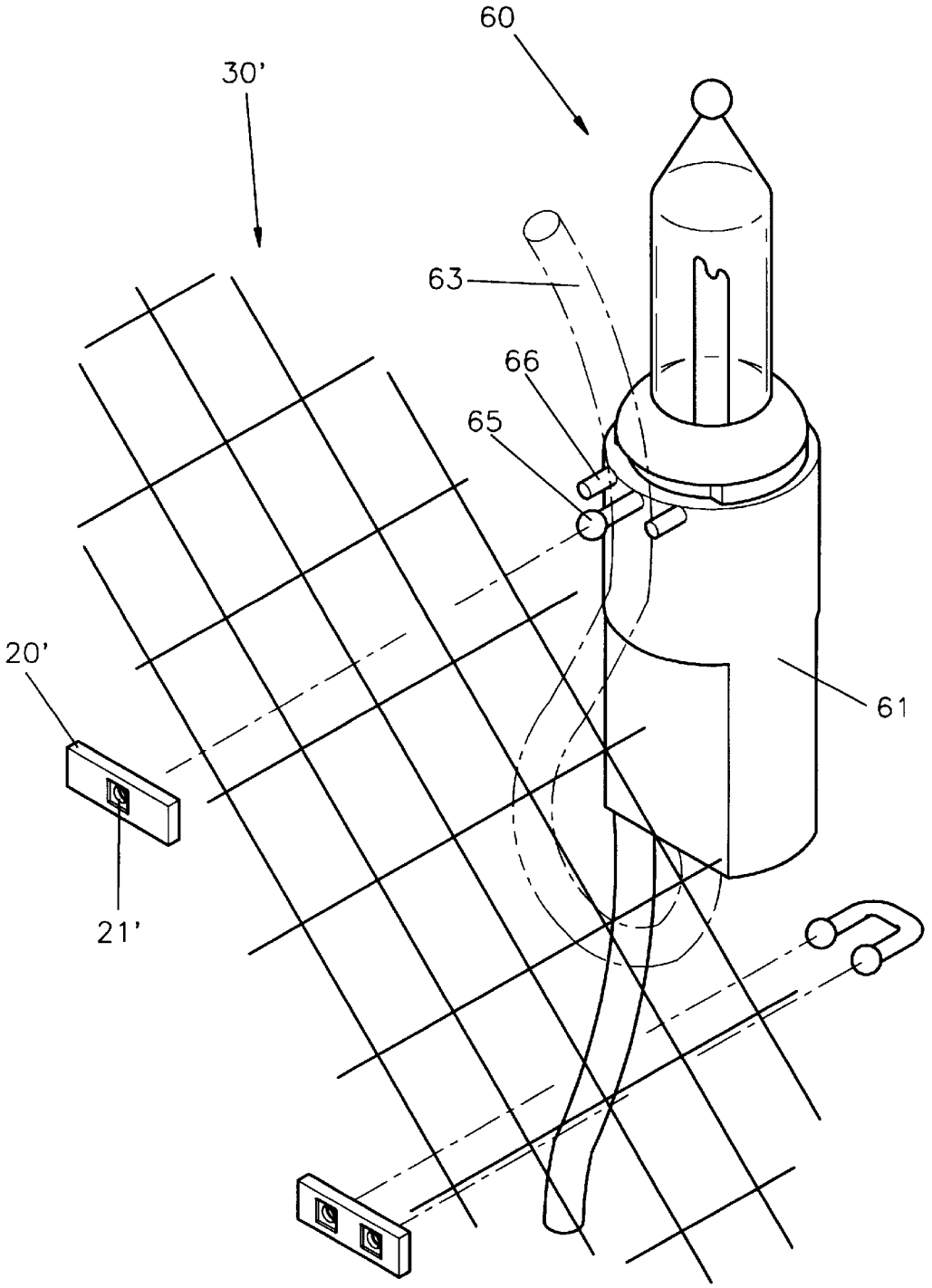
FIG. 6 is a perspective view of a fourth lamp and a portion of a net device.
Figure 7:
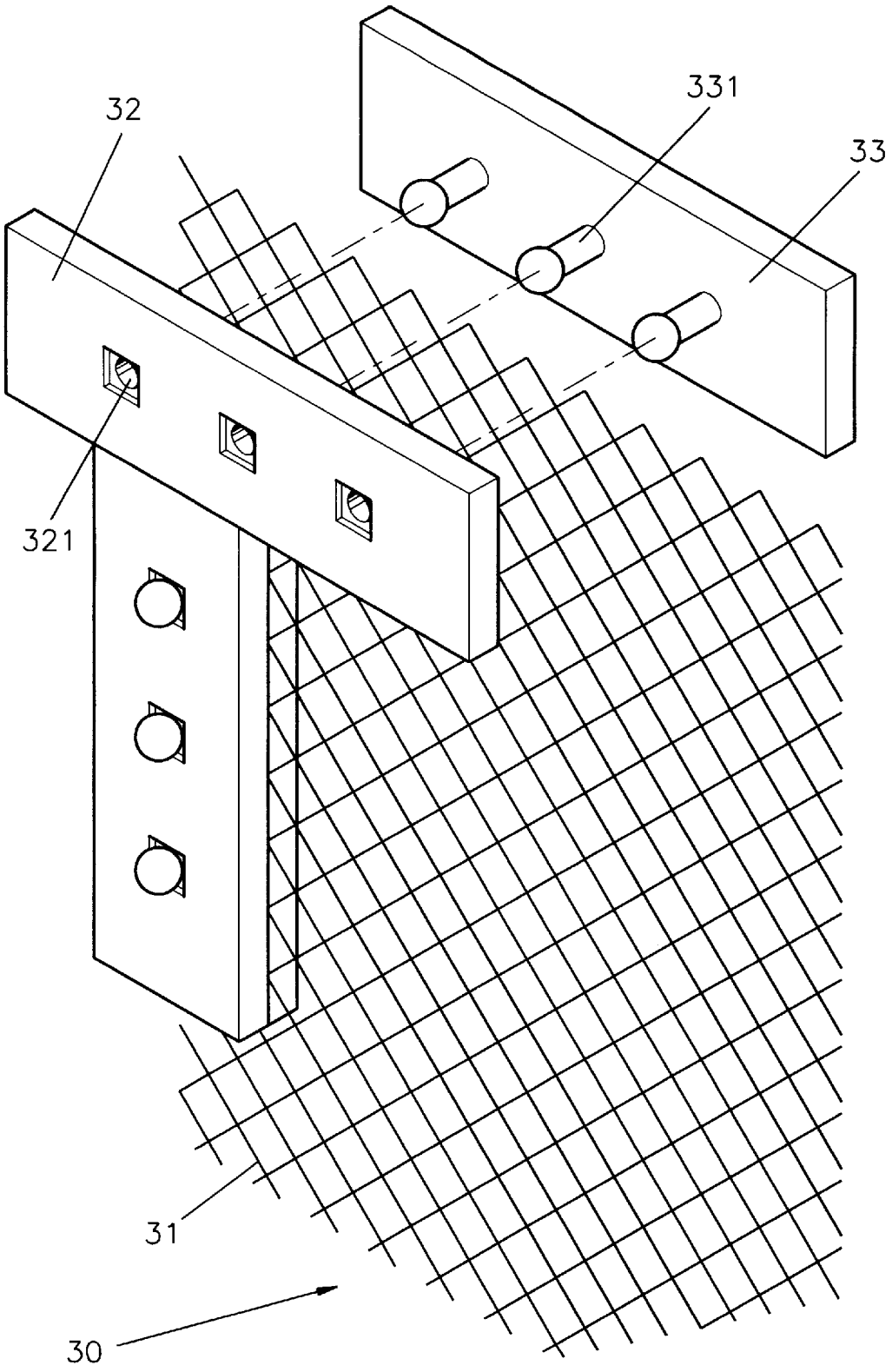
FIG. 7 is a partially perspective view of a net device.

Referring to FIG. 6, a fourth lamp 60 comprises a socket 61, a plurality of short round posts 66 disposed on the socket 61, a long round post 65 disposed on the socket 61, and two wires 63 extended from the socket 61. A plate 20' has a round hole 21'. The long round post 65 passes through a net device 30' and is inserted in the round hole 21'.

Figure 8:
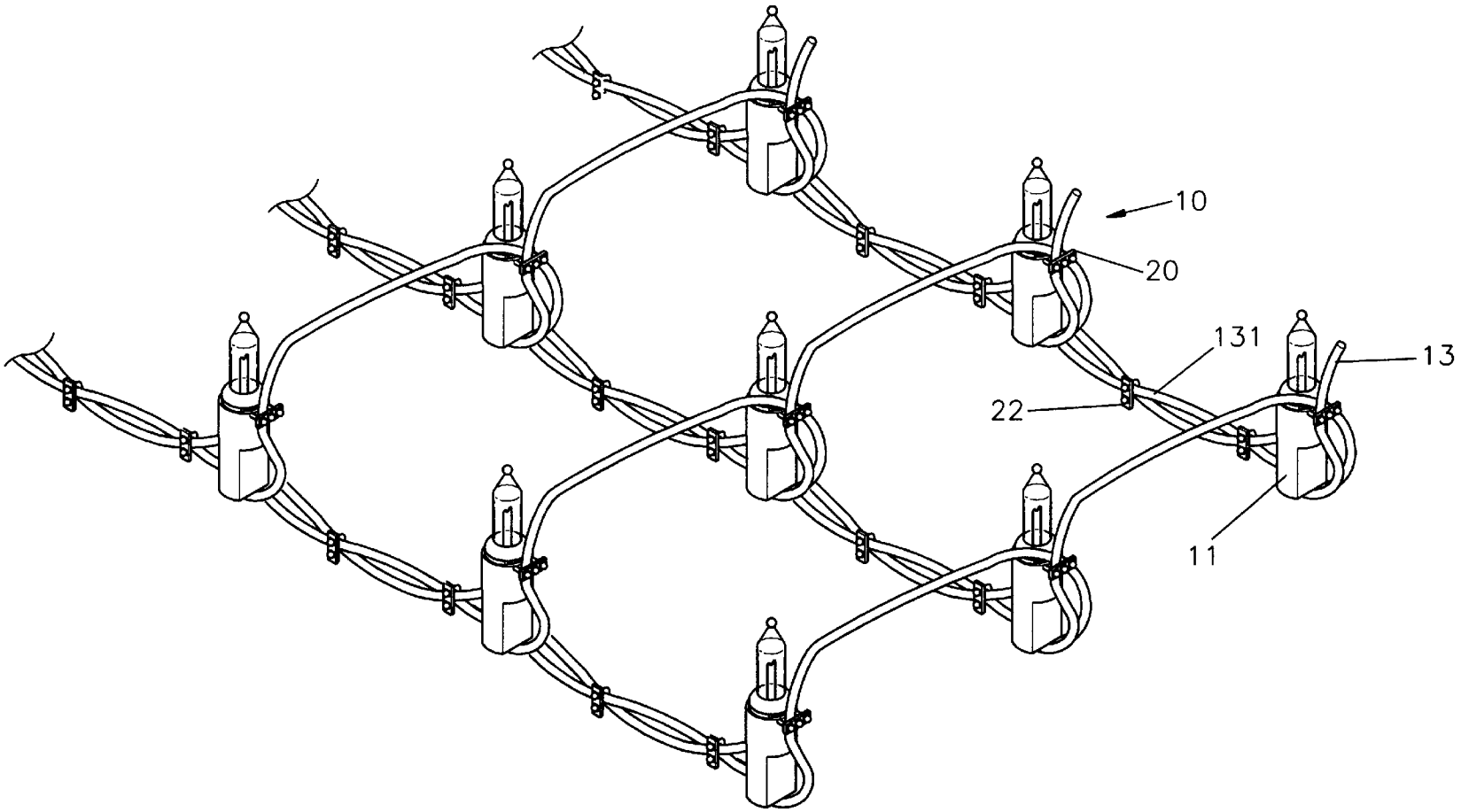
FIG. 8 is a schematic view illustrating a plurality of lamps forming a net lamp assembly.

Referring to FIG. 8, a net lamp assembly can arrange the wires as a net also.

Therefore, the patterns of the serial lamp assembly can be varied according to the arrangement of the user.

I claim:

1. A serial lamp assembly comprises:

a net device, a plurality of lamps disposed on the net device, each lamp having a bulb, a lamp holder receiving the bulb, a socket receiving the lamp holder, a plurality of posts disposed on said socket, a first wire extended from said socket, and a second wire extended from said socket, a first plate having a plurality of round holes, a second plate having a plurality of circular holes, a U-shaped rod passing around said first or second wire and through said net device and inserted into said circular holes of said second plate, said posts passing through said net device and inserted into said round holes of said first plate.

2. A serial lamp assembly as claimed in claim 1 said net device has a plurality of net strings, a plurality of first panels each including a plurality of through holes and a plurality of second panels each including a plurality of pillars passing through said net strings and inserting into the through holes of said first panels.

3. A serial lamp assembly as claimed in claim 1, wherein said posts has a long post and two short posts.

4. A serial lamp assembly as claimed in claim 1, wherein said posts are in round shapes.

5. A serial lamp assembly as claimed in claim 1, wherein said posts are in rectangular shapes.

6. A serial lamp assembly as claimed in claim 1, wherein said posts are in triangular shapes.

* * * * *